United States Patent [19]

Potter

[11] 4,262,272

[45] Apr. 14, 1981

[54] IGNITION COIL

[75] Inventor: Bernard A. Potter, Birmingham, England

[73] Assignee: Lucas Industries Limited, Birmingham, England

[21] Appl. No.: 143,961

[22] Filed: Apr. 25, 1980

[30] Foreign Application Priority Data

May 25, 1979 [GB] United Kingdom ..... 18381/79

[51] Int. Cl.[3] ..... H01F 27/02

[52] U.S. Cl. ..... 336/90; 174/17 VA; 220/366; 361/272

[58] Field of Search ..... 174/17 VA, 525; 361/272, 274, 35, 38; 123/634; 220/207, 208, 366; 336/90, 92

[56] References Cited

U.S. PATENT DOCUMENTS 2,816,682 12/1957 Brucker ..... 220/366 X 3,302,664 2/1967 Plamann ..... 220/366 X

*Primary Examiner*—Thomas J. Kozma

*Attorney, Agent, or Firm*—Ladas & Parry

[57] ABSTRACT

An ignition coil, for a spark ignition system, comprising a hollow casing closed at one end by a base and closed at its opposite end by an electrically insulating cap carrying at least the high voltage output terminal of the coil. Primary and secondary windings are housed within the casing, and an annular resilient sealing gasket is trapped between mutually presented faces of the casing and the cap to seal the interface of the casing and the cap. Adjacent said gasket the casing has at least one localized region so shaped as to provide a weak point in the seal effected by the gasket between the casing and the cap, whereby when the pressure within the casing exceeds a predetermined value the sealing action at said weak point fails so relieving the excess pressure in the casing.

2 Claims, 3 Drawing Figures

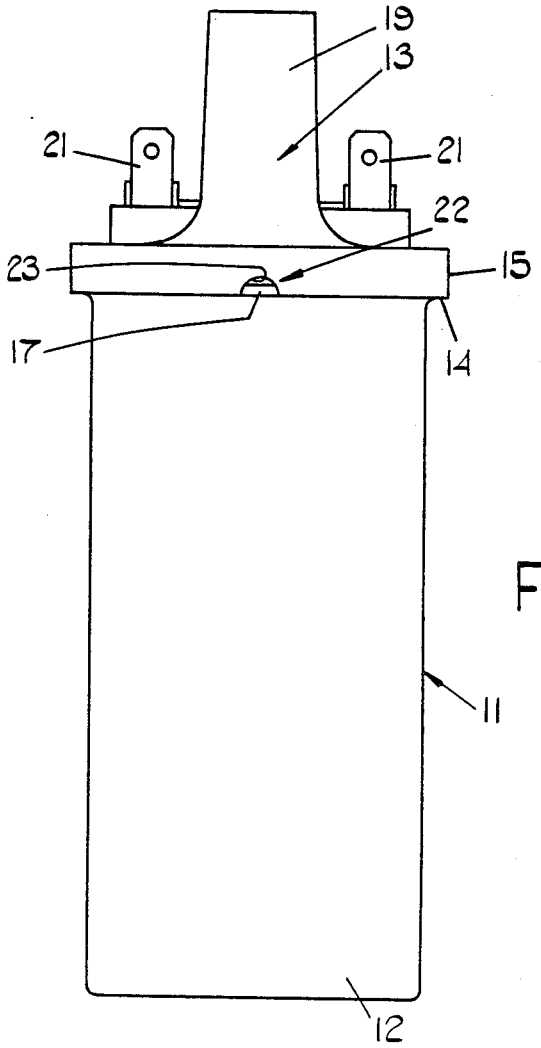
FIG.1.
FIG.2.
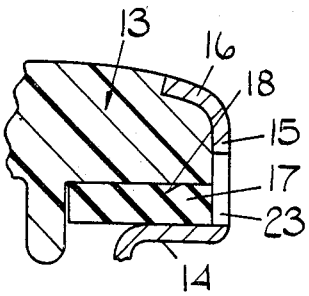
FIG.3.
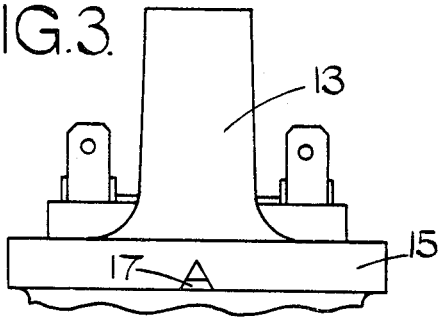

IGNITION COIL

This invention relates to an ignition coil for use in an internal combustion engine spark ignition system.

With the advent, in spark ignition systems, of electronic switching units whereby the current flowing in the primary winding of the ignition coil is controlled both in amplitude and in time, a danger arises that in the event of a failure of the control circuit including the switching unit the primary winding of the coil may be subject to excessive power dissipation as a result of either or both of excessively high current and prolonged energisation. Excessive power dissipation can result in generation of high temperatures with consequential build-up of dangerously high pressure within the coil, and in an oil-filled coil in particular, such heat build-up can result in an internal pressure rise sufficient to burst the coil. Clearly such an occurrence could prove to be extremely dangerous to anyone in the vicinity of the coil. It is known to provide the casing of an ignition coil with a safety valve in the form of a displaceable or rupturable plug closing an aperture in the wall of the casing of the coil. However, the provision of such a safety valve is expensive in that it requires the casing to be formed, prior to assembly of the coil, with an aperture, and in that it requires the provision of an extra component namely the plug. Additionally the plug may be expose to mechanical damage since it will be readily accessible on the exterior of the casing. Failure of the coil due to a manufacturing fault discovered during the final testing of the coil will probably result in scrapping of the coil and of course in such circumstances the costs involved in the provision of the safety valve are wasted.

It is an object of the present invention to provide an ignition coil wherein the risks of explosive failure of the coil owing to pressure build-up are minimised in a more efficient manner than has previously been found in the prior art.

An ignition coil according to the invention comprises a hollow casing closed at one end by a base and closed at its opposite end by an electrically insulating cap carrying at least the high voltage output terminal of the coil, primary and secondary windings within the casing, an annular resilient sealing gasket trapped between mutually presented faces of the casing and the cap to seal the interface of the casing and the cap, and, the casing having, adjacent said gasket, at least one localised region so shaped as to provide a weak point in the seal effected by the gasket between the casing and the cap, whereby when the pressure within the casing exceeds a predetermined value the sealing action at said weak point fails so relieving the excess pressure in the casing.

Preferably the casing includes a peripheral flange against which said gasket is trapped by a peripheral region of the cap, and the flange includes at its periphery an upstanding, circumferentially extending wall which encircles the cap and which is deformed to overlie the periphery of the cap to trap the cap against said flange, said localised region being a region of said wall, and the shaping thereof being the provision therein of an aperture through which a part of the gasket is exposed.

On example of the invention is illustrated in the accompanying drawings wherein:

FIG. 1 is a side elevational view of an ignition coil,

FIG. 2 is a fragmentary sectional view on the line 22 in FIG. 1 to an enlarged scale, and FIG. 3 is a view similar to FIG. 1 of a modification.

Referring to the drawings, the ignition coil includes a hollow, circular cylindrical casing 11 closed at one end by an integral base 12 and closed at its opposite end by a moulded synthetic resin cap 13 the material of which is electrically insulating.

The casing 11, 12 is formed from aluminum by a reverse extrusion, or deep drawing process and has its end closed in use by the cap 13 the casing 11 is shaped to define an integral, radially outwardly extending peripheral flange 14. Integral with the flange and extending at right angles thereto at the periphery of the flange is a circumferential wall 15 within which, in use, the periphery of the cap 13 seats. The cap 13 is secured to the casing 11 in use by deformation of the free edge of the wall 15 to overlie the cap 13 as shown at 16 in FIG. 2. An annular gasket 17 formed from an oil resistant synthetic rubber is trapped between the flange 14 and a mutually presented face 18 of the cap 13 and serves to seal the interface of the cap 13 and the casing 11. The deformation of the free edge of the wall 15 to secure the cap 13 to the casing 11 is performed under sufficient pressure to ensure adequate sealing of the cap 13 to the casing 11 by way of the gasket 17.

The cap 13 is formed with an integral hollow chimney 19 within which the high voltage output terminal of the ignition coil is housed. Low voltage terminals 21 of the coil are also supported on the cap 13 the terminals being insulated from one another by the material of the cap 13. Within the casing 11 are disposed the conventional primary and secondary windings of the coil, and the core of the coil. The connections between the core, the primary and secondary windings, and the various terminals on the cap are completely conventional, and form no part of the present invention. Free spaces within the casing 11 are filled with a predetermined ratio of oil and air also in a completely conventional manner. As is known, the oil filling the voids within the casing 11 aids cooling of the windings in use, and also aids electrical insulation of the windings.

The ignition coil described up to this point is totally conventional, and it is known that such coils can exhibit a tendency to explosive failure in the event that the pressure of the coil exceeds a predetermined maximum. With the advent of electronic control circuits including electronic switching arrangements in vehicle ignition systems, a fault condition can arise wherein the primary winding of the coil is subject to excessive power dissipation which generates heat, and the heating of the coil in turn results in a large rise in pressure within the coil. It has been found that, as the pressure within the coil continues to rise, a point is reached where the coil explodes so that the contents of the casing, including the hot oil, are scattered. This is obviously extremely dangerous. For example, it is not unknown when an ignition failure occurs in a vehicle, for the coil to remain energised while the vehicle owner, or a mechanic, is investigating the ignition system. In such circumstances the investigator may be working in close proximity to the coil with the engine cover of the vehicle open when the coil explodes.

In order to minimize the risks of violent and unpredictable failure, the ignition coil shown in the accompanying drawings is provided with a relief arrangement as follows.

The wall 15 of the casing 11 is provided with a localised region 22 containing a part circular aperture 23. The aperture 23 has a base adjacent the junction of the flange 14 and wall 15 and exposes the outer edge of a small part of the gasket 17. The aperture 23 of the region 22 defines a weak point in the sealing of the cap 13 to the casing 11, and thus predicts the point at which failure of the seal will occur as the pressure rises within the casing 11. Thus, the ignition coil can be mounted with the region 22 facing towards the engine of the vehicle, or in some other direction such that it will not be directly facing any one investigating the ignition system, or the region 22 can be shielded to prevent the discharge being directed towards the investigator. The weakening of the seal between the cap 13 and casing 11 at the region 22 is such that explosive failure of the ignition coil will not occur, since as the pressure rises a point will be reached at which pressurized gas or oil leaks past the gasket 17 and issues from the aperture 23 thus relieving the excess pressure within the casing. Although hot oil and gas will still issue from the ignition coil it will do so in a controlled rather than an explosive manner, and the direction of the discharge can be controlled by appropriate mounting of the ignition coil so that it presents the minimum of danger to a possible investigator.

The size, and shaping of the aperture 23, together with its position can be varied to accommodate other parameters of the ignition coil, so ensuring that a controlled pressure relief occurs. Moreover, if necessary more than one localised region 22 containing an aperture 23 can be provided if desired. For example, in some coils a triangular aperture (FIG. 3) rather than the part circular aperture 23 may prove more suitable.

Where the casing is formed from relatively thin material such as aluminum, which is capable of flexure under the pressures likely to be experienced within the casing, then it is believed that pressure relief may occur as a result of flexure of the flange 14 adjacent the region 22 so that the route of the discharge of oil and hot gas is between the gaskets 17 and the flange 14. However, where the casing is formed from more rigid material, for example mild steel, as is often the case then the shaping of the aperture 23 is so arranged that the gasket 17 can be deformed under the internal pressure within the casing, to provide an escape route for the pressurized gas and oil. In such an arrangement it may be found that the gasket 17 has actually been partially extruded through the aperture 23.

It will be recognised that in some instances it may be desirable for the aperture 23 to extend in part into the flange 14, and as mentioned above the shaping, dimensions, and positioning of the aperture or apertures 23 will be dependent upon the results desired, and the parameters of the particular ignition coil. However, it is to be understood that the aperture or apertures 23 can be provided as the last step in the manufacture of the ignition coil, and so the cost of machining the aperture or apertures 23 can be saved if it is found, after assembly of the ignition coil that the ignition coil is in some way faulty.

It will be appreciated that in all of the examples mentioned above the pressure relief mechanism is afforded without the need for additional components in the construction of the ignition coil.

I claim:

1. An ignition coil, for use in an internal combustion engine spark ignition system, including a hollow casing closed at one end by a base and closed at its opposite end by an electrically insulating cap carrying at least the high voltage output terminal of the coil, primary and secondary windings within the casing, an annular resilient sealing gasket trapped between mutually presented faces of the casing and the cap to seal the interface of the casing and the cap, and, the casing having, adjacent said gasket, at least one localised region so shaped as to provide a weak point in the seal effected by the gasket between the casing and the cap, whereby when the pressure within the casing exceeds a predetermined value the sealing action at said weak point fails so relieving the excess pressure in the casing.

2. A coil as claimed in claim 1 wherein the casing includes a peripheral flange against which said gasket is trapped by a peripheral region of the cap, and the flange includes at its periphery an upstanding, circumferentially extending wall which encircles the cap and which is deformed to overlie the periphery of the cap to trap the cap against said flange, said localised region being a region of said wall, and the shaping thereof being the provision therein of an aperture through which a part of the gasket is exposed.

* * * * *